US005439501A

United States Patent [19]

Watanabe et al.

[11] Patent Number: 5,439,501

[45] Date of Patent: Aug. 8, 1995

[54] METHOD OF PROCESSING HOT DROSS OF ALUMINUM RESULTING FROM AN ALUMINUM SMELTING PROCESS AND A DEOXIDANT OBTAINED FROM SAID METHOD

[75] Inventors: Katsuzo Watanabe; Yoshihito Taki, both of Shizuoka, Japan

[73] Assignees: Yamaichi Metal Co., Ltd.; Yamaichi System Produce Co. Ltd., Shizuoka, Japan

[21] Appl. No.: 151,190

[22] Filed: Nov. 12, 1993

[30] Foreign Application Priority Data

Dec. 24, 1992 [JP] Japan ..... 4-357214
Jan. 5, 1993 [JP] Japan ..... 5-015948

[51] Int. Cl.[6] ..... C22B 7/00
[52] U.S. Cl. ..... 75/313; 75/672
[58] Field of Search ..... 75/672, 313

[56] References Cited

U.S. PATENT DOCUMENTS 4,565,572 1/1986 van Linden ..... 75/672
4,575,392 3/1986 Julliard ..... 75/672

*Primary Examiner*—Peter D. Rosenberg
*Attorney, Agent, or Firm*—Burns, Doane, Swecker & Mathis

[57] ABSTRACT

A method of processing hot dross resulting from an aluminum smelting process is carried out as follows. First, the hot dross is filled in a hollow container which has a porous bottom plate closing a bottom opening of the container. A solid plate is placed on the filled hot dross. Then, an impact load is applied successively on the hot dross via the solid plate by an appropriate hammer mechanism. By the application of successive impact load, the air and aluminum content in a molten state are expelled from the dross and discharged through the porous bottom plate. The resultant solidified dross contains metal aluminum content without oxidized or nitrided, and therefore is suitable for use as a deoxidant utilized in deoxidizing process of oxidation smelting of steel.

24 Claims, 3 Drawing Sheets

METHOD OF PROCESSING HOT DROSS OF ALUMINUM RESULTING FROM AN ALUMINUM SMELTING PROCESS AND A DEOXIDANT OBTAINED FROM SAID METHOD

BACKGROUND OF THE INVENTION

1. Field of the Invention

The present invention relates to a method of processing hot dross of aluminum resulting from an aluminum smelting process. The present invention relates also to a deoxidant for use in deoxidizing process of oxidation smelting of steel.

2. Description of Related Art

Conventionally, hot dross of aluminum resulting from an aluminum smelting process has been treated as follows to recover aluminum contents therein. First, hot dross of aluminum is scraped out from a smelting-furnace of aluminum and filled into a container. Then, the hot dross of aluminum filled in the container is added with a large amount of flux so that the hot dross of aluminum reacts with flax to oxidize. With this oxidation, the hot dross of aluminum is heated to about 850 degrees of Centigrade in order that rigid, high protective oxide layers ($\gamma$-$Al_2O_3$ spinel-type cubic system) covering the aluminum droplets residing in the hot dross are transformed to low protective oxide layers ($\alpha$-$Al_2O_3$, hexagonal system).

Thereafter, the hot dross of aluminum is subject to mechanical stirring so that molten aluminum residing in the hot dross in the form of droplets covered with the low protective oxide layer is removed the oxide layer therefrom and divided from the removed low protective oxide layer. At the same time, during the mechanical stirring process, the aluminum droplets become those of larger size and descend toward the bottom of the container. After the aluminum droplets gathered on the bottom of the container are recovered from the container, the dross residues in the powder state are cooled by a water-cooling drum and abandoned as an industrial waste.

The conventional method of processing the hot dross of aluminum has several defects. First, since a large amount of flux is used to recover the aluminum content residing in the hot dross, there gives rise to problems that dusts containing a large amount of chloride are generated and that a large amount of heat is generated in an explosive manner. These may cause the environmental disruption.

Second, the hot dross after the aluminum content is removed therefrom is in a state heated to a temperature exceeding 1200 degrees of Centigrade, and therefore it must be cooled rapidly so as to suppress reaction of aluminum content thereof with oxygen and nitrogen. However, rapid cooling cannot be carried out with the conventional water-cooling drum. In addition, explosive evaporation of water may occur when the hot dross is subject to a cooling water. Further, since the hot dross after the aluminum content is removed is in a powder state and so has a large amount of surface area, where the hot dross is cooled for a long period of time in the atmosphere, metal aluminum residing in the hot dross reacts with oxygen and nitrogen. This causes to prevent the remaining metal aluminum in the dross from effective reuse. Furthermore, since the dross after cooling process contains more than 10 weight percents of nittided aluminum, it must be reacted with water to transform the nittided aluminum into ammonia gas and aluminum hydroxide before disposal as an industrial waste. However, since the reaction rate of the nitride aluminum and water is extremely low, this process is not applicable industrially.

Third, since the hot dross after the molten aluminum is removed is in a powder state, a large amount of dust may be generated during cooling operation in which the cooling drum is rotated to cool the powders of hot dross. Thus, it is necessary to collect the generated dust by a dust collector.

Accordingly, an object of the present invention is to provide a method of processing hot dross resulting from an aluminum smelting process, which does not emit dust or explosive heat during the process to cause the environmental disruption.

The other object of the present invention is to provide a method of processing hot dross resulting from an aluminum smelting process, which effectively removes air contained in the hot dross to thereby prevent aluminum content remaining in the hot dross from reacting with oxygen or nitrogen.

Another object of the present invention is to provide a deoxidizing solid aluminum dross resulting from a method according to the present invention, which is utilized in deoxidizing process of molten steel.

SUMMARY OF THE INVENTION

In order to achieve the above and other objects, a method of processing hot dross resulting from an aluminum smelting process according to the present invention is characterized in that it includes the steps of filling the hot dross of aluminum resulting from an aluminum smelting process into a hollow container which has a porous bottom plate closing a bottom opening of the container, setting a solid plate on the hot dross in the container, and applying an impact load on the hot dross via the solid plate to solidify the hot dross.

In a preferred embodiment, about 80 horse-power of impact load is applied on the hot dross via the solid plate. The application of the impact load is carried out continuously until the hot dross is compressed to one-half to one-fifth in volume thereof, preferably one-fourth to one-fifth in volume thereof. The impact load is applied on the solid plate at a rate of 30 to 100 times per minute for a period of about three minutes or more. Alternatively, the impact load can be applied on the solid plate in such a manner to repeat three to six times a cycle of applying the impact load on the hot dross at a rate of 200 to 300 times per minute for a period of about 3 to 5 seconds and taking an interval of about 10 to 20 seconds with no application of impact load.

It is preferable that the porous plate closing the bottom of the container is formed therein with round through holes having a diameter of about 7 to 20 mm. It is also preferable that the porous plate is releasably attached to the bottom of the container so that the solidified dross can easily be extruded from the container.

The solid plate placed on the hot dross in the container is preferably of cylindrical shape or rectangular shape.

According to the present invention, the hot dross resulting from an aluminum smelting process is filled into the container having the porous plate on the bottom end. Then the solid plate is placed on the hot dross and applied thereon the impact load of the above strength at the above-mentioned rate for the above-mentioned period, so that the hot dross is compressed to an extent that the volume thereof becomes one-half to one-fifth the original volume thereof. During this operation, since aluminum droplets remaining in the hot dross are divided from the rest of hot dross contents due to the difference in specific gravity between aluminum and the other contents of the hot dross, the aluminum droplets collide with one another to merge and become large size of aluminum droplets. At the same time, a large amount of air which is remained in voids among the aluminum droplets and the remaining contents of the hot dross is also expelled from the hot dross. Accordingly, the aluminum droplets residing in the hot dross are recovered from the container through the holes of the porous bottom plate, and at the same time a large amount of air remained in the hot dross is also expelled from the hot dross.

By removing the aluminum droplets and air, the hot dross becomes powdered dross, which in turn compressed on the porous plate with the impact load repeatedly applied thereon to become solid state and remained on the porous plate.

According to the method of the present invention, since a large amount of air contained in the hot dross is removed, the remaining aluminum in the hot dross is prevented from nitriding or oxidating, thus heat generation due to nitriding and oxidating is suppressed. The loss of metal aluminum in the hot dross is also suppressed. In addition, although the temperature of the hot dross elevates due to heat of reaction when the hot dross is compressed by applying the impact loads, it returns to the temperature before compression when the hot dross is free of compression by the impact loads. Thus, the temperature of the hot dross does not elevate excessively and the loss of metal aluminum in the hot dross is suppressed. Further, since the excessive heat generation from the hot dross is avoided, the environmental disruption can be prevented.

Furthermore, the resultant solidified dross contains a large amount of metal aluminum, while it contains very few aluminum nitride.

According to another aspect of the present invention, in consideration that the resultant solidified dross from the above method contains a large amount of metal aluminum, the resultant solidified dross is utilized as a deoxidant for use in oxidation smelting of steel. In the present invention, the resultant solidified dross is crushed or divided to form deoxidizing aluminum dross briquettes of predetermined size and shape.

Japanese Patent Laid-Open No. SHO 55-220 discloses a method of deoxidation in which aluminum ash is blown into molten steel with argon gas or nitrogen gas and after that gas stirring is carried out to remove oxygen from the molten steel. An improvement of this method is disclosed in Japanese Patent Laid-Open No. SHO 58-93810, in which calcium flux is blown into the molten steel after the aluminum ash is blown into the molten steel. However, either of these methods is not expected to produce an satisfactory deoxidation effect for smelting steel to produce killed steel, semi-killed steel and the like, these steels being required severely to reduce concentration of oxygen and nitrogen.

Thus, it has been proposed a deoxidation method of using an aluminum material of 90 to 99 percents in purity in place of aluminum ash. In this method, the aluminum material reacts with oxygen in molten steel to be deoxidized to form alumina which is floated on the surface of the molten steel. The alumina is removed from the molten steel, whereby oxygen contained in the molten steel is removed. The aluminum material is used in the form of small particles referred to as shots, relatively large-sized particles of trapezoidal or semi-sphere shape, ingot weighing 1 to 5 kilograms, and the like.

However, the aluminum material of high purity is too expensive to use as a deoxidant. In addition, since the aluminum material must be formed into predetermined shape and size before using as a deoxidant, a forming facilities is required, which inevitably causes to rise a production cost of the aluminum deoxidant.

According to the present invention, since the resultant solidified dross is used as a deoxidant which contains a large amount of metal aluminum, a deoxidant of high quality can be produced at a low price.

BRIEF DESCRIPTION OF THE DRAWINGS

The above and other objects and advantages of the present invention will be more apparent from the following description with reference to attached drawings,in which.

PREFERRED EMBODIMENTS OF THE INVENTION

While the present invention will be described with respect to preferred embodiments, it is not intended to limit the present invention to those embodiments. On the contrary, it is intended to cover all alternatives, modifications and equivalents thereof as may be included in the present invention defined by the attached claims.

Referring now to FIGS. 1 to 7, a first embodiment of the present invention will be described.

Figure 1:
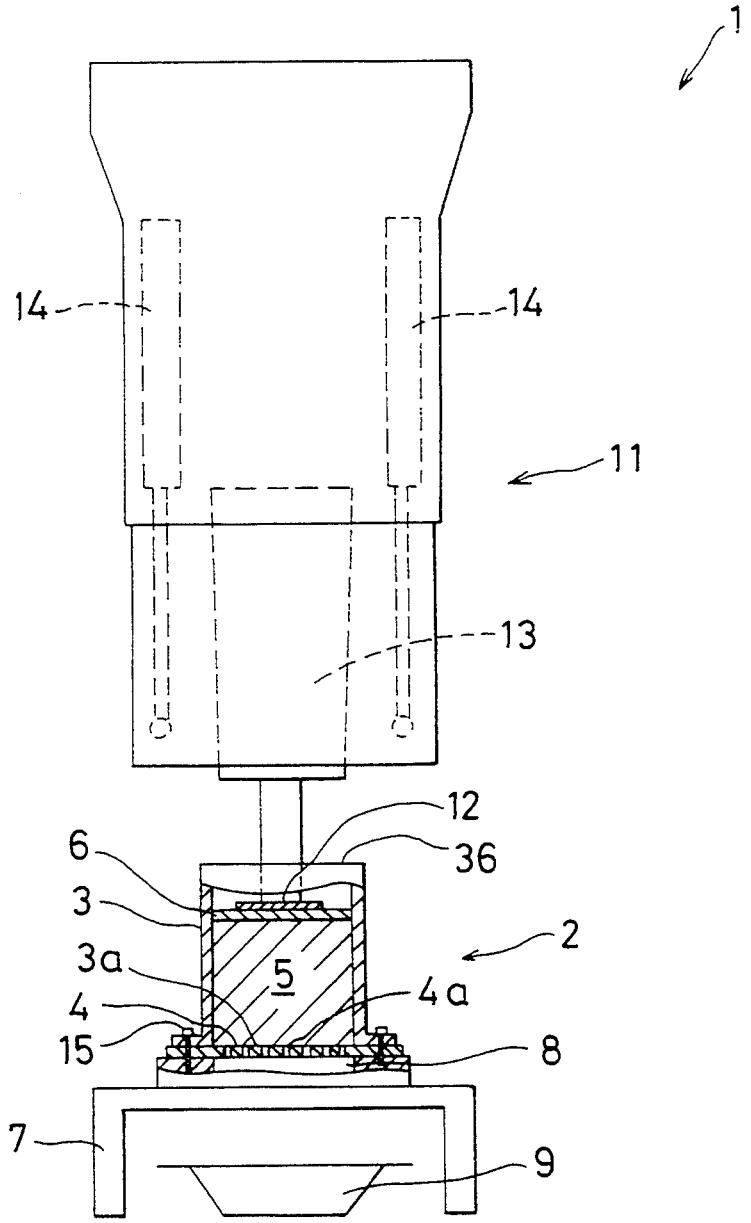
FIG. 1 is a schematic view of an example of an apparatus for applying an impact load on a hot dross in a container, which is adopted to carry out a method of the present invention; and, FIGS. 2 to 7 show successive compression processes of the hot dross according to a method of the present invention.

FIG. 1 illustrates schematically an apparatus applicable for a method of processing hot dross according to the present invention. The apparatus 1 comprises a container 2 which has a cylindrical body 3 and a porous bottom plate 4 releasably attached to a bottom open end 3*a* of the cylindrical body 3. A hot dross 5 is filled into the inner space of the container 2 through an upper opening 3*b* of the body 3. The cylindrical body 3 and the porous plate 4 are made of heat-resisting material such as a refractory metal or the like. The apparatus 1 has a metal plate 6 which is designed to place on the hot dross 5 filled in the cylindrical body 3.

The porous bottom plate 4 attached on the bottom of the cylindrical body 3 is mounted on a frame 7. The frame 7 is formed therein with an opening 8 facing the porous bottom plate 4, and a recovery pan 9 is placed immediately below the opening 8.

A hammer mechanism 11 is placed above the container 2, which has a hammer head 12 designed to apply an impact load on the metal plate 6 placed on the hot dross 5 in the container 2, and a drive mechanism 13 which drives to travel the hammer head 12 reciprocally in the vertical direction at a rate of 400 times per minute with an impact load of about 80 horsepower. Since the hot dross 4 is gradually compressed by application of the impact load, the hammer mechanism 11 has a pair of hydraulic cylinders 14 to adjust the position of the hammer head 12 in the vertical direction according to the compression of the hot dross 5 in the container 2.

In the present embodiment, the cylindrical body 3 has an inner diameter of 400 mm and a thickness of 5.0 mm. The metal plate 6 has a diameter of 399 mm and a thickness of 20 mm. While, the porous bottom plate 4 is formed with a plurality of round through holes 4*a* having a diameter of 12 mm. This plate 4 is releasably attached to the bottom of the container 2 by means of screws 15. In the embodiment, the screws 15 also function to fix the assembled container 2 on the frame 7 as shown in FIG. 1.

The method of processing hot dross resulting from an aluminum smelting process utilizing the above-constituted apparatus 1 will be described. First, the porous bottom plate 4 and the cylindrical body 3 are mounted in this order on the frame 7 and are fixed thereon by means of the screws 15 to assemble the container 2 having the upper opening 3*b*. The container 2 is thus fixedly mounted on the frame 7. Then, a hot dross of aluminum weighing about 100 kilograms which is scraped out from an aluminum smelting furnace is filled in the container 2.

Then, the metal plate 6 is placed on the hot dross 5 in the container 2, and the hammer head 12 of the hammer mechanism 11 is set on the metal plate 6. The hammer mechanism 11 is then driven to thereby travel the hammer head 12 reciprocally in the vertical direction at a rate of 400 times per minute for a period of 4 seconds, whereby an impact load is applied successively on the hot dross 5 through the metal plate 6. The impact load applied to the hot dross 5 is set about 80 horsepower. As the hot dross 5 is tamped down by the application of the successive impact loads, the air contained in the hot dross 5 is pushed out from the inside to the outside of the hot dross 5. Since the hot dross 5 is confined by the metal plate 6 and the inner circumferential surface of the cylindrical body 3, the air pushed out from the hot dross 5 travels downwards and discharged outside the container 2 through the through holes 4*a* formed in the bottom plate 4. At the same time, aluminum content in a molten state is also travels downwards and discharged through the holes 4*a* of the bottom plate 4. The discharged aluminum content drops on and recovered by the recovery pan 9.

Figures 2, 3, 4:
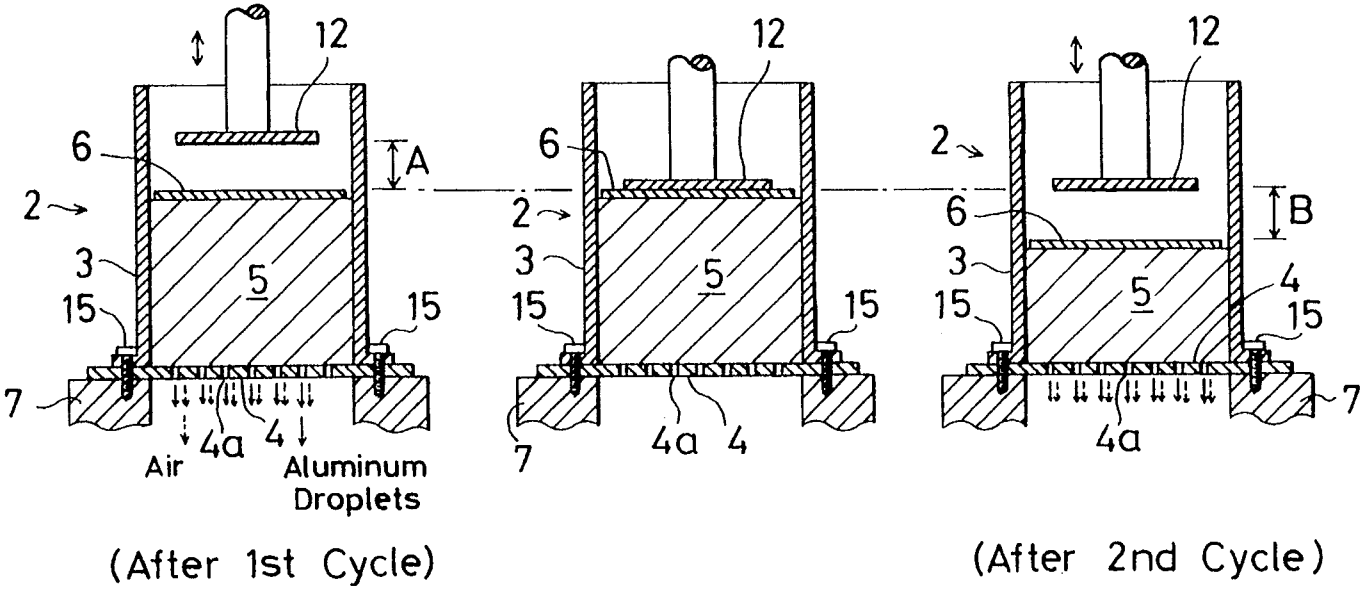

After the application of impact load for 4 seconds, the hot dross 5 is compressed and reduced in volume, so that the upper surface of the hot dross 5 is lowered by about 10 mm from the original level. Thus, a gap A is formed between the initial position of the hammer head 12 and the metal plate 6 on the compressed hot dross 5, as shown in FIG. 2. Thereafter, the hot dross 5 is stayed for a period of about 15 seconds without applying the impact load.

After the interval of about 15 seconds, the hammer head 12 is lowered to adjust its initial position so that it contacts the metal plate 6 as shown in FIG. 3, and then a second cycle of application of impact load is commenced. In the second cycle, the hammer head 12 is driven to travel reciprocally in the vertical direction ,to thereby strike the metal plate 6, whereby the impact load of about 8 horsepower is applied successively on the hot dross 5 through the metal plate 6 for 4 seconds as like as the first cycle of application of the impact load. By this, the air still remained in the hot dross 5 is dispersed outside of the hot dross 5 and discharged from the container 2 through the porous bottom plate 4. After the second cycle of impact-load application, the hot dross 5 is tampered down and reduced further in volume, and the upper surface of the hot dross 5 is lowered by about 10 mm. Thus, a gap B is formed between the hammer head 12 and the metal plate 6 on the hot dross 5 as shown in FIG. 4. After the second cycle of impact-load application, the hot dross 5 is stayed for an interval of about 15 seconds.

Figures 5, 6, 7:
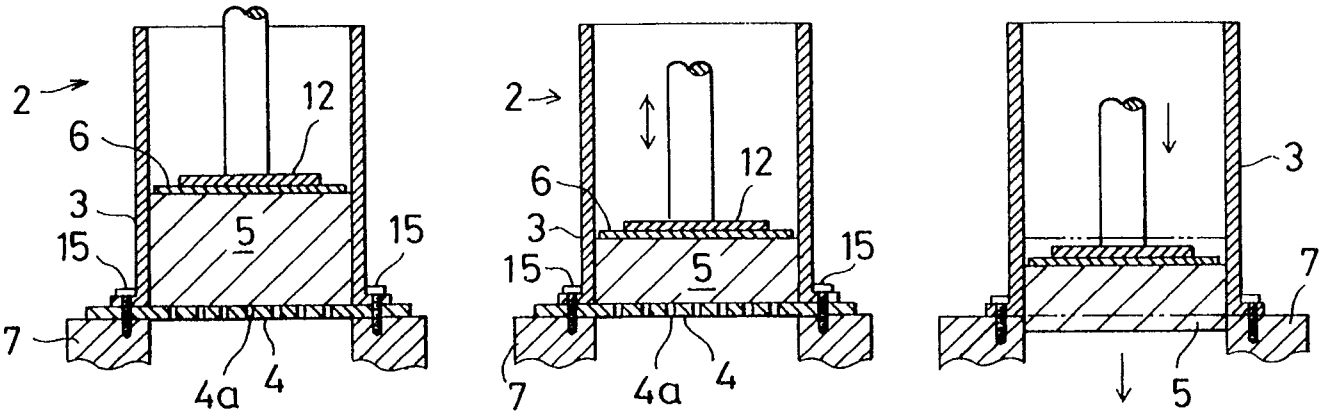

After the interval, the hammer head 12 is lowered to adjust its initial position so that it contacts the metal plate 6 as shown in FIG. 5, and then a third cycle of impact-load application is carried out as like as those of the first and second cycles of impact-load application. Thus, the air still remained in the hot dross 5 after the second cycle is discharged from the porous bottom plate 4. In addition, the hot dross is compressed and reduced in volume so that the upper surface of the hot dross is lowered.

The impact-load application cycles are carried out repeatedly until the volume of the hot dross 5 is no more reduced. Typically, the hot dross 5 is compressed until the volume thereof reduced to one-half to one-fourth the original volume. The hot dross 5 is thus compressed in the container 2 to become a dross cake (a solidified dross) as shown in FIG. 6.

Thereafter, the container 2 is released from the frame 7 and the bottom plate 4 is removed. Then only the cylindrical body 3 is mounted on the frame 7, and the dross cake in the body 3 is extruded therefrom by using the hammer head 12 as shown in FIG. 7.

In the present embodiment, the shape of the holes formed in the porous bottom plate 4 is round. Alternatively, polygonal shapes such as a triangle, rectangle and the like having an area of about 70 to 300 $mm^2$ are also preferable. In addition, the impact load of about 80 horsepower is successively applied on the hot dross at a rate of about 400 times per minute for about 4 seconds in the present embodiment. These parameters depend on the size of the container, the amount of hot dross filled in the container. It has been found to be preferable that the impact load be applied at a rate of about 200 to 600 times per minute for at least about 2 seconds. The number of cycles of impact-load application is preferably one by which the volume of the hot dross becomes about one-fourth to one-fifth the original volume thereof.

According to the present embodiment, the hot dross resulting from an aluminum smelting process is filled in the container, the metal plate is placed on the filled hot dross, and then the impact load is applied intermittently to the hot dross via the metal plate, whereby a large amount of air contained in the hot dross can be expelled from the hot dross and, at the same time, the metal aluminum contained in the hot dross can also be expelled from the hot dross to recover through the porous bottom plate. Since the air is removed from the hot dross, the aluminum content in the hot dross is prevented from reacting with oxygen or nitrogen, which means that exothermotic reactions can be suppressed. Therefore, the aluminum content in the hot dross can effectively be recovered for reuse.

In addition, since the hot dross is recovered in a solid state after the process as mentioned above, dust generation can be prevented. Thus, the environmental disruption due to heat and dust generations during processing the hot dross can be avoided.

Furthermore, the resultant dross cake can be utilized as a deoxidant for metal smelting process because it contains the aluminum content, almost all of which remains without oxidizing or nitriding.

Based on this recognition, according to the present invention, the resultant dross cake is used as a deoxidant for metal smelting process. Where the resultant dross cake is used as a deoxidant, the dross cake is crushed with using a jaw crusher or the like to form deoxidizing dross briquettes of prescribed size and shape. The thus obtained deoxidizing dross briquettes are manually or mechanically thrown into a smelting furnace of steel. The deoxidizing dross briquettes have a large amount of aluminum content remaining therein, and exhibit an excellent deoxidizing effect. Further, since the deoxidizing dross briquettes contain very few amount of nitride, an increase in nitrogen in the steel can be avoided.

In comparison to this, where the hot dross is conventionally processed to form a deoxidant for steel, this deoxidant contains 20 to 30 times aluminum nitride and aluminum oxide and therefore an effective deoxidizing effect cannot be expected. Further, since the dross which is conventionally process is in a powder state, a lance means or the like is required to throw the powder dross in a smelting furnace for steel.

Next, a second embodiment of the present invention will be described. The apparatus as shown in FIG. 1 can also be used for this embodiment.

In the present embodiment, 150 kilograms of hot dross resulting from an aluminum smelting process is filled in the container 2 comprised by the cylindrical body 3 and the porous bottom plate 4. The cylindrical body 3 and the porous bottom plate 4 are made of heat-resistant steel. The cylindrical body 3 has an inner diameter of 400 mm and a thickness of 5.0 mm, while the porous bottom plate 4 is 6 mm thick and is formed therein with a plurality of through holes 4*a* having a diameter of 12 mm. The porous bottom plate 4 is releasably attached on the bottom open end of the cylindrical body 3.

Then, on the hot dross of aluminum filled in the container 2, the metal plate 6 is placed. The metal plate 6 is also made of heat-resistant steel and has a diameter of 399 mm and a thickness of 20 mm. After that, a hammer head 12 of a hammer mechanism 11 is set on the metal plate 6.

The hammer head 12 is driven to travel reciprocallly in the vertical direction, to thereby apply an impact load of about 80 horsepower on the hot dross 5 in the container 2 via the metal plate 6 with the hammer head 12 being continuously lowered by a pair of hydraulic cylinders 14, 14. The application of the impact load is carried out at a rate of about 50 times per minute for a period of about 4 minutes.

By the successively applied impact loads, the air contained in the hot dross 5 is expelled therein. Since hot dross 5 is confined upward and circumferentially by the metal plate 6 and cylindrical body 3, almost all of the air moves downward to discharge through the holes 4*a* of the porous bottom plate 4. At the same time, molten aluminum content contained in the hot dross 5 is also expelled and is recovered by a recovery pan 9.

By the end of the application of impact load, the hot dross 5 in the container 2 is compressed to reduce in volume, and the height thereof is lowered by about 350 mm from its original level. At this condition, the hot dross 5 is no more compressed by further application of impact load. According to the present embodiment, the volume of the hot dross 5 is found to be reduced two-ninths the original volume.

After the impact-load application is finished, the compressed dross 5 is left as it is for about 15 minutes, and then the porous bottom plate 6 is removed from the cylindrical body 3. Finally, the compressed dross which is solidified to be cake shape (dross cake) is extruded from the container 2 by applying an impact with the hammer head 12.

In the present embodiment, the porous bottom plate 4 is formed therein with a plurality of round holes having a diameter of 12 mm. As the shape of the holes formed in the porous bottom plate 4, it has been found that, instead of round shape, polygonal shapes such as triangular, rectangular shapes and the like having an area of about 70 to 300 $mm^2$ can also be adopted. In addition, the impact load of 80 horsepower is applied on the hot dross at a rate of about 50 times per minute for about 4 minutes. These parameters depend on the size of the container, the amount of hot dross filled in the container and the like. It has been found that the impact load is preferably applied at a rate of about 30 to 100 times per minute. It has also been found that the impact load is preferably applied successively for at least 3 minutes until the volume of the hot dross becomes about one-fourth to one-fifth the original volume thereof.

We claim:

1. A method of processing hot dross of aluminum resulting from an aluminum smelting process including the steps of:

filling the hot dross of aluminum resulting from the aluminum smelting process into a hollow container which has a porous bottom plate closing a bottom opening of said container;

setting a solid plate on said hot dross filled in said container;

successively applying an impact load having a value of about 80 horsepower on said hot dross in said container via said solid plate to solidify the hot dross until said hot dross is substantially no more reduced in volume; and extruding a resultant solidified dross from said container.

2. A method of processing hot dross of aluminum resulting from an aluminum smelting process according to claim 1, wherein said impact load is successively applied on said hot dross in said container until a volume of said hot dross becomes about one-half to one-fifth an original volume thereof.

3. A method of processing hot dross of aluminum resulting from an aluminum smelting process according to claim 1, wherein said impact load is successively applied on said hot dross in said container until a volume of said hot dross becomes about one-fourth to one-fifth an original volume thereof.

4. A method of processing hot dross of aluminum resulting from an aluminum smelting process according to claim 3, wherein said impact load is applied in a manner that said impact load is successively applied on said hot dross in said container at a rate of about 200 to 300 times per minute for a period of about 3 to 6 seconds, and then an interval of about 10 to 20 seconds takes with no impact load applied, and thereafter a cycle of said application of impact load and said interval is repeatedly carried out for two to five times.

5. A method of processing hot dross of aluminum resulting from an aluminum smelting process according to claim 3, wherein said impact load is applied successively on said hot dross in said container at a rate of about 30 to 100 times per minute for a period of about at least three minutes.

6. A method of processing hot dross resulting from an aluminum smelting process including the steps of:

filling the hot dross of aluminum resulting from the aluminum smelting process into a hollow container which has a porous bottom plate closing a bottom opening of said container, wherein said porous bottom plate is formed therein with a plurality of holes, each having an area of about 40–300 $mm^2$;

setting a solid plate on said hot dross filled in said container;

applying an impact load successively on said hot dross via said solid plate to solidify the hot dross, wherein said impact load is applied in a manner having a frequency of about 200 to 600 times per minute for a period of about 2 to 6 seconds and then an interval of about 10 to 20 seconds is interposed and thereafter a cycle of said impact load application and said interval is repeated until a volume of said hot dross becomes about one-half to one-fifth an original volume thereof; and extruding a resultant solidified dross from said container.

7. A method of processing hot dross resulting from an aluminum smelting process according to claim 6 wherein said holes formed in said porous bottom plate are round holes having an inner diameter of about 7 to 20 mm.

8. A method of processing hot dross resulting from an aluminum smelting process according to claim 6, wherein said porous bottom plate is releasably attached on said bottom opening of said container.

9. A method of processing hot dross resulting from an aluminum smelting process according to claim 6, wherein said hollow container is of a cylindrical shape and said solid plate is a circular plate having an outer diameter which is smaller by about 1 mm than an inner diameter of said hollow container.

10. A method of processing hot dross resulting from an aluminum smelting process according to claim 6, wherein the impact load is applied with an amplitude of about 10 mm to 60 mm.

11. A method of processing hot dross resulting from an aluminum smelting process including the steps of:

filling the hot dross of aluminum resulting from the aluminum smelting process into a hollow container which has a porous bottom plate closing a bottom opening of said container, wherein said porous bottom plate is formed therein with a plurality of holes having an area of about 40 to about 300 $mm^2$;

setting a solid plate on said hot dross filled in said container;

applying an impact load successively on said hot dross via said solid plate to solidify the hot dross, wherein said impact load is applied in a manner having a frequency of about 30 to 100 times per minute until a volume of said hot dross becomes about one-fourth to one-fifth an original volume thereof; and extruding a resultant solidified dross from said container.

12. A method of processing hot dross resulting from the aluminum smelting process according to claim 11, wherein said holes of said porous bottom plate are round holes having an inner diameter of about 7 mm to about 20 mm.

13. A method of processing hot dross resulting from the aluminum smelting process according to claim 11, wherein said porous bottom plate is releasably attached on said bottom opening of said container.

14. A method of processing hot dross resulting from the aluminum smelting process according to claim 11, wherein said hollow container is of a cylindrical shape and said solid plate is a circular plate having an outer diameter which is smaller by about 1 mm than an inner diameter of said hollow container.

15. A method of processing hot dross resulting from an aluminum smelting process according to claim 11, wherein the impact load is applied with an amplitude of about 10 mm to 60 mm.

16. A method of processing hot dross resulting from an aluminum smelting process according to claim 11, wherein the plurality of holes are round holes.

17. A deoxidizing aluminum dross briquette for use in a deoxidizing process of oxidation smelting of steel, said briquette comprising a solidified dross of aluminum obtained from a method including the steps of:

filling the hot dross of aluminum resulting from an aluminum smelting process into a hollow container which has a porous bottom plate closing a bottom opening of said container, wherein said porous bottom plate is formed therein with a plurality of holes having an area of about 40 to about 300 $mm^2$;

setting a solid plate on said hot dross filled in said container;

applying an impact load successively on said hot dross via said solid plate to solidify the hot dross, wherein said impact load is applied in a manner having a frequency of about 200 to 600 times per minute for a period of about 2 to 6 seconds and then an interval of about 10 to 20 seconds is interposed and thereafter a cycle of said impact load application and said interval is repeated until a volume of said hot dross becomes about one-half to one-fifth an original volume thereof; and extruding a resultant solidified dross from said container.

18. A deoxidizing aluminum dross briquette of claim 17, wherein said impact load has ah amplitude of about 10 mm to 60 mm.

19. A deoxidizing aluminum dross briquette for use in a deoxidizing process of oxidation smelting of steel, said briquette comprising a solidified dross of aluminum obtained from a method including the steps of:

filling the hot dross of aluminum resulting from an aluminum smelting process into a hollow container which has a porous bottom plate closing a bottom opening of said container, wherein said porous bottom plate is formed therein with a plurality of round holes having an area of about 40 to about 300 $mm^2$;

setting a solid plate on said hot dross filled in said container;

applying an impact load successively on said hot dross via said solid plate to solidify the hot dross, wherein said impact load is applied in a manner having a frequency of about 30 to 100 times per minute until a volume of said hot dross becomes about one-fourth to one-fifth an original volume thereof; and extruding a resultant solidified dross from said container.

20. A deoxidizing aluminum dross briquette of claim 19, wherein said impact load has an amplitude of about 10 mm to 60 mm.

21. A method of manufacturing a deoxidizing aluminum dross briquette for use in a deoxidizing process of oxidation smelting of steel, said manufacturing method comprising the steps of:

filling the hot dross of aluminum resulting from an aluminum smelting process into a hollow container which has a porous bottom plate closing a bottom opening of said container, wherein said porous bottom plate is formed therein with a plurality of holes having an area of about 40 to about 300 $mm^2$;

setting a solid plate on said hot dross filled in said container;

applying an impact load successively on said hot dross via said solid plate to solidify the hot dross, wherein said impact load is applied in a manner having a frequency of about 200 to 600 times per minute for a period of about 2 to 6 seconds and then an interval of about 10 to 20 seconds is interposed and thereafter a cycle of said impact load application and said interval is repeated until a volume of said hot dross becomes about one-half to one-fifth an original volume thereof;

extruding a resultant solidified dross from said container; and crushing said resultant solidified dross to form deoxidizing aluminum dross briquettes of predetermined size and shape.

22. A deoxidizing aluminum dross briquette of claim 21, wherein said impact load has an amplitude of about 10 mm to 60 mm.

23. A method of manufacturing a deoxidizing aluminum dross briquette of use in deoxidizing process of oxidation smelting of steel, said manufacturing method comprising the steps of:

filling the hot dross of aluminum resulting from an aluminum smelting process into a hollow container which has a porous bottom plate closing a bottom opening of said container, wherein said porous bottom plate is formed therein with a plurality of round holes having an area of about 40 to about 300 $mm^2$;

setting a solid plate on said hot dross filled in said container;

applying an impact load successively on said hot dross via said solid plate to solidify the hot dross, wherein said impact load is applied in a manner having a frequency of about 30 to 100 times per minute until a volume of said hot dross becomes about one-fourth to one-fifth an original volume thereof;

extruding a resultant solidified dross from said container; and crushing said resultant solidified dross to form deoxidizing aluminum dross briquettes of predetermined size and shape.

24. A deoxidizing aluminum dross briquette of claim 23, wherein said impact load has an amplitude of about 10 mm to 60 mm.

* * * * *